US006125519A

United States Patent [19]

Kaibach et al.

[11] Patent Number: 6,125,519

[45] Date of Patent: Oct. 3, 2000

[54] SETTING TOOL

[75] Inventors: Werner Kaibach, Buchloe; Stefan Raber, Kaufering, both of Germany

[73] Assignee: Hilti Aktiengesellschaft, Schaan, Liechtenstein

[21] Appl. No.: 09/208,130

[22] Filed: Dec. 9, 1998

[30] Foreign Application Priority Data

Dec. 16, 1997 [DE] Germany ..... 197 55 769

[51] Int. Cl.[7] ..... B25B 27/14

[52] U.S. Cl. ..... 29/275; 29/255; 29/280

[58] Field of Search ..... 29/275, 270, 280, 29/238, 255

[56] References Cited

U.S. PATENT DOCUMENTS 1,654,310 12/1927 Reiter ..... 29/271

3,174,218 3/1965 McConaha ..... 29/271

5,644,889 7/1997 Getz ..... 52/713

*Primary Examiner*—David A. Scherbel

*Assistant Examiner*—Lee Wilson

*Attorney, Agent, or Firm*—Brown & Wood, LLP

[57] ABSTRACT

A setting tool for anchoring a spreading anchor having an anchor rod (1) and an expansion sleeve (4), the setting tool including a sleeve-shaped body (8) having an axial blind bore (11) opening at an end surface (13) and a lead-in surface (10) for receiving axial impacts, and provided at a rear end of the sleeve-shaped body (8) remote from the end surface (13) at which the blind bore (11) opens, and a marking element (17) arranged in a bottom (15) of the axial blind bore (11) of the sleeve-shaped body (8) for forming a permanent mark in a rear end surface (3) of the anchor rod (1) at the end of a setting process.

12 Claims, 2 Drawing Sheets

SETTING TOOL

BACKGROUND OF THE INVENTION

1. Field of the Invention

The present invention relates to a setting tool for anchoring a spreading anchor having an anchor rod and an expansion sleeve, with the setting tool including a sleeve-shaped body having an end surface, an axial blind bore opening at the end surface, and a lead-in surface for receiving axial impacts and provided at a rear end of the sleeve-shaped body remote from the end surface at which the blind bore opens.

2. Description of the Prior Art

For anchoring of a number of conventional attachment elements in a constructional component, specially formed setting apparatuses became necessary. E.g., mandrel-like setting tools are used for anchoring spreading anchors having a sleeve provided with an expansion region and an inner thread, and an axially displaceable expanding member. This setting tool has several sections, which have different diameters, and an annular stop shoulder. The setting tool is inserted through a rear opening of the sleeve until the front end of the setting tool abuts the expanding member. The mostly cone-shaped expanding member is driven into the through-bore of the expansion sleeve by axial impacts applied to the rear end of the setting tool until the stop shoulder of the setting tool abuts the rear edge of the expansion sleeve. The expanding member, upon being driven in, expands radially the expansion region of the sleeve, with the spreading anchor being forcelockingly anchored in a preliminary formed receiving bore.

The known setting tool has a wedge-shaped projection formed on the annular stop shoulder and which form, upon the tool being impacted, an indentation in the rear edge of the expansion sleeve. This indentation shows that the expanding member has been adequately driven in the through-bore of the expansion sleeve, and that the expansion region of the expansion sleeve has been completely expanded. This setting tool can be used only for anchoring spreading anchors which have an expansion sleeve provided with an inner thread. However, the indentation, which is formed in the rear edge of the expansion sleeve, is often barely visible, e.g., when the spreading anchors seats relatively deeply in the receiving bore. With a constructional element being attached, the edge of the expansion sleeve is mostly not visible any more. In this case, it is not any more possible to establish, without dismounting the attached constructional element, whether the spreading anchor has been properly anchored.

Another category of attachment elements is represented by spreading anchors including an anchor rod and an expansion sleeve with a radially expanding expansion region. In most cases, the anchor rod has an outer thread, which serves as load application means, and a head provided at a front end of the anchor rod and having an ever increasing diameter. For anchoring the spreading anchor in a preliminary formed bore, the expansion sleeve is driven over the anchor rod head whereby the expansion region of the sleeve is expanded radially. In most cases, the expansion sleeve is driven by axial impacts onto the head portion of the anchor rod which is supported on the bore bottom. When the spreading anchor is formed as an undercut self-cutting anchor with the expansion tabs formlockingly engaging in a formed undercut, the expansion sleeve, in addition to being driven in axially, is also rotated. As a result of the rotation, the radially expanding expansion tabs form an undercut in the vicinity of the bore bottom. The anchoring of the spreading anchor is insured by a formlocking connection of the expansion tabs with the undercut formed in the receiving bore during the setting process.

For setting spreading anchors of this category, primarily, sleeve-shaped setting tools are used. These setting tools have an axial bore in which the anchor rod is received during a setting process. The end surface associated with the bore opening contacts the rear edge of the expansion sleeve. The sleeve is driven over the anchor rod head portion with axial impacts applied to the rear end of the setting tool. For transmission of a rotational torque to the expansion sleeve, in case of anchoring of an undercut self-forming spreading anchor, the front end surface of the sleeve-shaped setting tool is provided with projections engageable in corresponding recesses formed in the rear edge of the expansion sleeve. The opposite end of the setting tool is provided with a shank to be received in a chuck of an electrical hand-held drill, e.g., a percussion drill. Upon actuation of the percussion drill, the setting tool rotates and percussion drives the expansion tool onto the head portion. The radially expanding expansion tabs of the rotatable sleeve form an undercut in the bore wall upon the sleeve being displaced over the head portion of the anchor rod.

For controlling the setting process of a spreading anchor, there are provided setting marks. The setting marks can, e.g., be formed as flutes provided on the outer surface of the setting tool. The alignment of the flutes with the bore edge shows that a setting process has ended, and the expansion sleeve has been driven sufficiently deep. In order for these flutes to provide an adequate information of a reliable anchoring of the spreading anchor in a bore, the bore should be formed with an exactly predetermined depth, with a too deep formed bore, the marks on the setting tool may not provide a reliable information of whether the expansion sleeve has been expanded sufficiently wide, which can negatively affect the resulting holding values. The setting marks can also be provided on the anchor rod, e.g., by providing color marks on the anchor rod circumference. The arrangement of the color marks is so selected that they become visible only when the sleeve has already been driven along the head portion of the anchor rod a sufficient amount. However it may happen, with a relatively deep bore, that the color marks would disappear into the bore and would be barely visible. After an attachment of a constructional component, the marks on the anchor rod are mostly not visible as they are usually covered by the constructional element. Therefore, a correct setting of this spreading anchor, in particular, when it is formed as an undercut self-cutting spreading anchor, cannot be determined visually after the end of the setting process and mounting of the constructional component.

Accordingly, an object of the present invention is to eliminate the drawback of the prior art setting tools. Another object of the present invention is to provide a setting tool for a spreading anchor having an anchor rod and an expansion sleeve, in particular for an undercut self-cutting spreading anchor, which would enable to conduct a visual control of the setting in a simple way after the end of the setting process. The visual control of the setting should show whether the spreading anchor has adequately been anchored in the constructional component. Further, an easy inspection of the attachment points after the attachment of the constructional element should be insured.

SUMMARY OF THE INVENTION

These and other objects of the present invention, which will become apparent hereinafter, are achieved by providing a setting tool for anchoring a spreading anchor and, in particular, for anchoring an undercut self-cutting spreading anchor having an anchor rod and an expansion sleeve, and including a sleeve-shaped body having an axial blind bore opening at an end surface. A lead-in surface is provided at a rear end of the sleeve-shaped body remote from the end surface at which the blind bore opens, for receiving axial impacts. A marking element is arranged in a bottom of the axial blind bore of the sleeve-shaped body for forming a permanent mark in a rear end surface of the anchor rod at the end of a setting process.

Providing a marking element in the bottom of the blind bore of the setting tool permits to form marks on the rear end surface of the anchor rod, which remains visible after the attachment of a constructional element. This insures an easy secondary visual control. The marking element provides a permanent mark which is retained for a long time and practically insures a setting control all the time. The mark is formed only at the end of the setting process. The formation of the mark immediately indicates that the minimal axial displacement of the sleeve, necessary for the expansion of the spreading anchor, has been effected. The depth of the mark permits to judge to what degree the sleeve has expanded.

In a preferred embodiment of the present invention, the marking element is formed as a spike-like projection extending from the bottom of the blind bore. The projection extends past the bottom of the blind bore by a distance a ratio of which to the blind bore diameter amounts to from about 0.1 to about 1.7 and, preferably, from 0.3 to 1.2. The projecting spike-like projection engages, upon the displacement of the impact-driven sleeve, the rear end surface of the anchor rod which is being received in the blind bore. The axial impacts drive the projection into the end surface of the anchor rod, and the projection forms a permanent mark in a form of indentation. The extension of the projection beyond the bottom of the blind bore insures that with a correct setting process, a mark with an adequate depth will be formed in the rear end surface of the anchor rod. However, this extension beyond the blind bore bottom is small enough so it does not create any excessive resistance to the axial displacement of the sleeve at the end of the setting process.

Advantageously, the spike-like projection is formed as a stepped member having, along its length, at least two different diameter section. At that, the front section, which has a smaller diameter, extends toward the free end of the projection. The stepped formation of the projection provides preconditions for forming the marks in accordance with a degree of setting of the spreading anchor. This should provide a possibility to quantify the obtained circumference of the expansion of the expansion region of the expansion sleeve, e.g., to make a conclusion as to whether predetermined load holding values are obtained.

With regard to the dimensions of the stepped projection, it is preferred that the front section has a diameter a ratio of which to the diameter of the rear section remote from the blind bore bottom amounts to from about 0.2 to about 0.7, preferably, from 0.3 to 0.6. This provides for the necessary rigidity of the projection, without increasing the dimensions of the front section, which would have made it more difficult to drive it into the rear end surface of the anchor rod, and thereby, without hindering the displacement of the expansion sleeve.

Preferably, the front section includes a spike-shape section which extends toward the free end of the front section and has a length a ratio of which to a total length of the front section amounts to from about 0.2 to about 0.7, and preferably, from 0.3 to 0.6. The spike-shaped section facilitates driving of the projection into the rear end surface of the anchor rod during the setting process. Further, the deeper the projection is driven into the rear end surface of the anchor rod, the larger is the mark diameter. The size of the mark indicates the degree of expansion. The depth of the mark permits to evaluate the displacement of the expansion sleeve and, thereby, the degree of expansion of the expansion region of the sleeve. The ratio of total length of the front section to the minimal displacement of the expansion sleeve amounts to from about 0.1 to about 0.5.

In order to keep the additional forces necessary for forming the marks within tenable limits, the geometrical proportions of the setting tool are selected so that a ratio of the diameter of the rear section of the projection to the bore diameter amounts to from about 0.1 to 0.5, preferably, from 0.2 to 0.4.

To further simplify the secondary setting control, there are provided additional embossing elements in the transition region between the front and rear sections of the projection. Preferably, the embossing elements are formed as pin-shaped projections, annular cutters or the like. Thereby, the necessity to monitor the mark depth can be eliminated. Here, e.g, it is sufficient to observe the appearance of an additional concentric mark in order to determine whether a complete expansion of the expansion region of the expansion sleeve has been achieved during the setting process of a spreading anchor.

Advantageously, the marking element is formed as a pin-like hard metal insert located in a hole formed in the bottom of a blind bore. A hard metal insert having a desired shape can be produced relatively easy. Because the marking element is subjected to a certain wear, advantageously, the hard metal insert is inserted with a possibility of being replaced.

In a particularly advantageous embodiment of a setting tool according to the present invention, in particular, in a setting tool used for percussion-rotational anchoring of undercut self-cutting spreading anchors, at least one claw-like driver is provided on the end surface of the sleeve-shaped body of the setting tool. The claw-like driver projects axially from the end surface of the sleeve-shaped body. At the rear end of the sleeve-shaped body, remote from the end surface with the projecting driver, there is provided a shank to be received in a chuck of a hand-held drill, e.g., a percussion drill. The drill rotates the setting tool about its axis. The claw-like driver is engaged in a correspondingly formed recess in the rear end surface of the expansion sleeve and transmits a torque to the expansion sleeve. Thereby, the sleeve is rotated while being displaced over the widening head portion of the anchor rod in a setting direction by axial impacts. The ever expanding expansion tabs of the expansion sleeve shave, as a result of rotation of the sleeve, the bore wall material and, thus, form an undercut.

BRIEF DESCRIPTION OF THE DRAWINGS

The features and objects of the present invention will become more apparent, and the invention itself will be the best understood from the following detailed description for the preferred embodiments when read with reference to the accompanying drawings, wherein.

DETAILED DESCRIPTION OF THE PREFERRED EMBODIMENTS

Figure 1A:
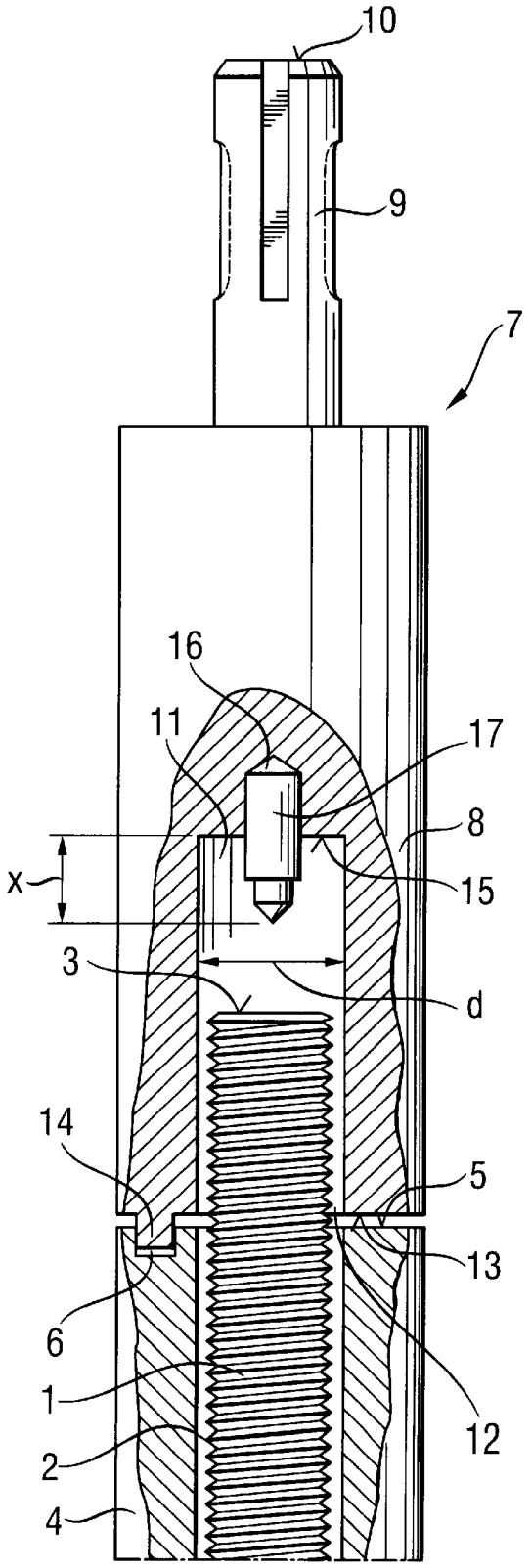
FIG. 1*a* shows an axial cross-sectional view of a setting tool according to the present invention in its initial position.
Figure 1B:
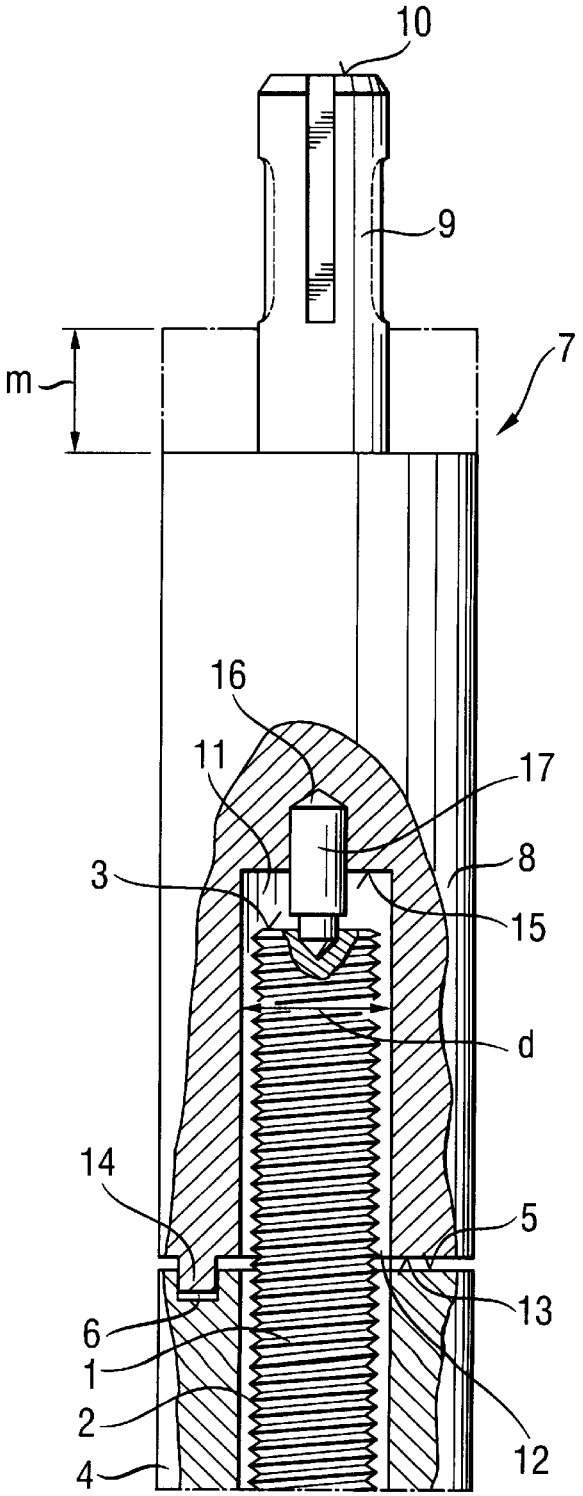
FIG. 1*b* shows an axial cross-sectional view of the setting tool according to the present invention in its end position.

A setting tool according to the present invention and shown in FIGS. 1*a*–1*b* is generally designated with a reference numeral 7. The setting tool 7 includes a sleeve-shaped body 8 provided with a blind bore 11. The mounth 12 of the blind bore 11 coincides with an end surface 13 of the sleeve-shaped body 8. Usually, the sleeve-shaped body 8 is formed as a cylindrical body. The outer surface of the sleeve-shaped body 8 can be continuous or be provided with axial slots. At the end of the sleeve-shaped body 8 opposite to the mounth 12 of the blind core 11, there is provided a shank 9 for inserting the setting tool 7 in a chuck of a hand-held drill, e.g., percussion drill. The free rear surface of the shank 9 forms a lead-in surface 10 to which impacts generated by the hammer of the percussion drill are applied.

A claw-shaped driver 14 extends from the end surface 13 of the body 8. The driver 14 cooperates with a corresponding recess 6 formed in the rear surface 5 of an expansion sleeve 4. The expansion sleeve 4 is axially displaceable along an anchor rod 1. An outer thread 2 provided on the anchor rod 1 functions as load application means for attachment of a constructional element. The spreading anchor, which is shown in FIGS. 1*a*–1*b,* is formed particularly as an undercut self-cutting anchor which is percussion anchored in a preliminary formed receiving bore. The expansion sleeve is displaced forward by impacts transmitted from the end surface 13 of the body 8 of the setting tool 7 to the rear end surface 5 of the expansion sleeve 4. Upon being displaced, the expansion sleeve 4 slides over the widening head portion of the anchor rod 1 which is supported on the bore bottom, with the expansion tabs of the expansion sleeve 4 expanding radially. The driver 14, which is engaged in the recess 6 of the expansion sleeve 4, transmits the rotation of the setting tool 7 to the sleeve 4. As a result, the radially expandable expansion tabs of the sleeve 4 form an undercut in the wall of the receiving bore. At the end of the setting process, the expansion sleeve 4 has been advanced by a minimal path M. The radially expanded expansion tabs form a form-locking connection with the cut-out undercut and the spreading anchor is anchored in the receiving bore.

According to the present invention, a marking element 17 is provided in the blind bore 11 of the body 8 of the setting tool 7. In the embodiments shown in the drawings, the marking element 17 includes a spike-like projection insertable into a hole 16 formed in the bottom 15 of the blind bore 11. The spike-shaped projection extends beyond the bottom 15 by a distance x a ratio of which to the diameter of the blind bore 11 amounts to from about 0.1 to about 1.7, preferably, from 0.3 to 1.2. At the end of the setting process, the spike-like projection contacts the anchor rod 1 and by subsequent axial impacts is impressed into the end surface 3 of the anchor rod 1. The resulting indentation, which is formed in the end surface 3, provides a noticeable mark which enables a user to control setting after an attachment of a constructional element to the anchor rod 1.

FIGS. 2–6 show different embodiment of the marking element 17. Though the marking element 17 can have a substantially same diameter along its entire length, preferably, it is formed as a stepped member, which is advantageous from the point of view of its rigidity. Besides, portions having different diameters can be used for forming further marks which can provide a user with additional information indicating the degree of setting. The marking element 17, which is schematically shown in FIGS. 2–6, have two different diameter portions along its length. A free projecting section 18 of the spike-like projection of the marking element 17 has a smaller diameter than the rear section 20 of the projection 17 which partially extends into the hole 16 formed in the bottom 15 of the blind bore 11. The ratio of the diameter V of the front section 18 to the diameter r of the rear section 20 amounts to from about 0.2 to about 0.7, preferably form 0.3 to 0.6. The diameter 2 of the rear section 20 is so selected that its ratio to the diameter d of the blind bore 11 amounts to from about 0.1 to about 0.5, preferably, from 0.2 to 0.4.

Figure 2:
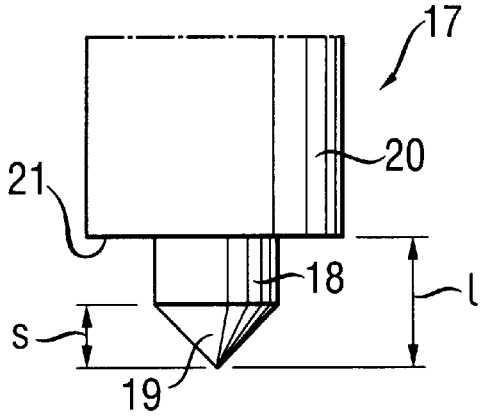
FIGS. 2–3 show elevational views of two embodiments of a marking element used with a setting tool according to the present invention.
Figure 3:
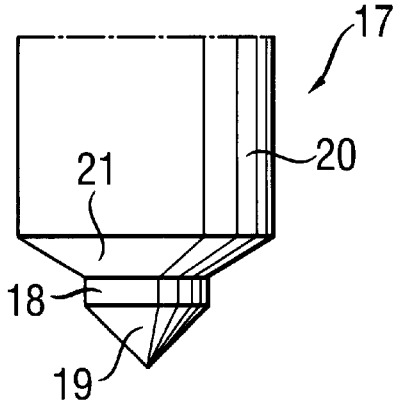
Figure 4:
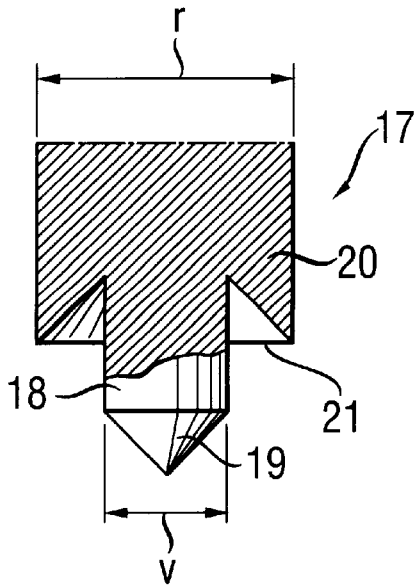
FIGS. 4–6 show cross-sectional views of further embodiments of a marking element used with a setting tool according to the present invention.
Figure 5:
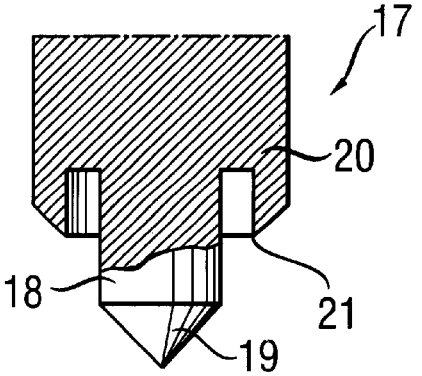
Figure 6:
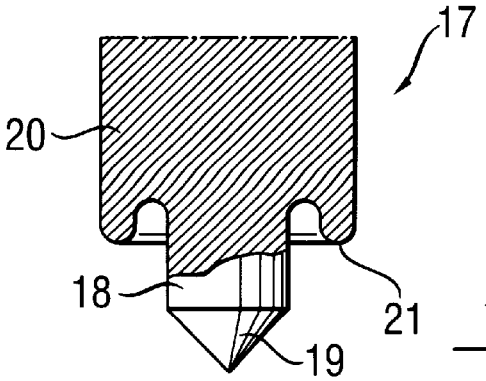

The front section 18 of the projection 17 has a total length l. In the direction to its front end, the diameter of the front section 18 is gradually reduced from a predetermined cross-section, ending in a point. The reduced diameter, spike-shaped portion of the front section 18 has a length s the ratio of which to the total length l of the front section 18 amounts to from about 0.2 to about 0.7, preferably, from 0.3 to 0.6. The different embodiments of the spike-like projection 17, which are shown in FIGS. 2–6, differ from each other primarily by the shape of a transition region 21 between the smaller diameter front section 18 and the larger diameter rear section 20. In FIG. 2, the transition region 21 is formed as an annular shoulder extending substantially transverse to the axis of the projection 17. The annular shoulder 21 forms, during a setting process, a definite end stop. Upon application of axial impacts, the annular shoulder can form an additional surface mark on the rear end surface of the anchor rod 1 which would concentrically surround the indentation formed with the spike-shaped section 19. In FIG. 3, the transition region 21 has a shape of a truncated cone. During a setting process, the truncated cone-shape transition region 21 can form an additional indentation with a bevel edge. The additional indentation in this case concentrically surround the indentation formed by the spike-shaped portion 19 of the front section 18. The radial extent of the bevel edge of the additional indentation depends on a degree of setting. In FIGS. 4 and 5, the transition region 21 is formed with a cutting annular edge. Upon the impression of the transition region 21 into the rear end surface 3 of the anchor rod 1, a ring-shaped mark, which is concentric with the indentation formed with the spike-shaped section 19 of the projection 17, is formed. In FIG. 6, the transition region 21 is formed as annular embossing surface. The annular embossing surface forms a ring-like indentation somewhat similar to that formed with the cutting annular edge of the transition region 21 shown in FIGS. 4–5. It should be understood that the cutting edges in FIGS. 4–5 and the embossing surface in FIG. 6 need not be formed as a continuous circle. the transition region 21 can be formed of separate projections arranged, e.g., along concentric circles. The length of the additional projections is so selected that the marks are formed from inside out in the radial direction. Then, a user can, e.g., based on the number of marks and on their appearance in the radial direction, make a conclusion of the degree of setting of the spreading anchor. The spike-like projection 17 preferably is formed of a hard material which can relatively easy be formed into a desired shape, e.g., of a sintered material.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A setting tool for anchoring a spreading anchor having an anchor rod (1) and an expansion sleeve (4), comprising a sleeve-shaped body (8) having an end surface (13), an axial blind bore (11) opening at the end surface (13), and a lead-in surface (10) provided at a rear end of the sleeve-shaped body (8) remote from the end surface (13) at which the blind bore (11) opens, for receiving axial impacts; and a marking element (17) arranged in a bottom (15) of the axial blind bore (11) of the sleeve-shaped body (8) for forming a permanent mark in a rear end surface (3) of the anchor rod (1) at an end of a setting process, wherein a claw-shaped driver (14) is provided on the end surface (13) of the sleeve-shaped body, the claw-shaped driver (14) projecting from the end surface (13) in an axial direction, and wherein a shank (9) for connecting the setting tool to a hand-held drill is provided at the rear end of the sleeve-shaped body (8), the lead-in surface (10) being formed on a free end of the shank (9).

2. A setting tool according to claim 1, wherein the ratio of the distance (x), by which the projection (17) extends beyond the bottom (15) of the blind bore (11) of the sleeve-shaped body (8), to the diameter (d) of the blind bore (11), is in a range from 0.3 to 1.2.

3. A setting tool according to claim 1, wherein the projection (17) is formed as a stepped member and has, along a length thereof, at least two sections (18, 20) having different diameters (v, r), and wherein a smaller diameter front section (18) extends toward a free end of the projection (17).

4. A setting tool according to claim 3, wherein a ratio of a diameter (v) of the smaller diameter front section (18) to a diameter (r) of a rear section (20) remote from the bottom (15) of the blind bore (11) amounts to from about 0.2 to about 0.7.

5. A setting tool according to claim 4, wherein the ratio of the diameter (v) of the front section (18) to the diameter (r) of the rear section (20) is in range from 0.3 to 0.6.

6. A setting tool according to claim 4, wherein the front section (18) has, at its front end, a spike-shaped section (19) having a length (s) a ratio of which to a total length (l) of the front section (18) amounts to from about 0.2 to about 0.7.

7. A setting tool according to claim 6, wherein the ratio of the length (s) of the spike-shaped section (19) to the total length (l) of the front section (18) is in a range from 0.3 to 0.6.

8. A setting tool according to claim 3, wherein a ratio of a diameter (r) of the rear section (20) of the projection (17) to the diameter (d) of the blind bore (11) amounts to from about 0.1 to about 0.5.

9. A setting tool according to claim 8, wherein a ratio of a ratio of a diameter (r) of the rear section (20) to the diameter (d) of the blind bore (11) is in a range from 0.2 to 0.4.

10. A setting tool according to claim 3, wherein the projection (17) has a transition region (21) between the front section (18) and the rear section (20) provided with embossing means.

11. A setting tool according to claim 10, wherein the embossing means is formed as one of spike-shaped extension and an annular cutter.

12. A setting tool according to claim 1, wherein the marking element (17) is formed as a pin-shaped hard metal insert arranged in a hole (16) provided in the bottom (15) of the blind bore (11).

* * * * *